US006040802A

United States Patent [19]

Smith et al.

[11] Patent Number: 6,040,802

[45] **Date of Patent: *Mar. 21, 2000**

[54] ANTENNA CROSS-POLAR SUPPRESSION MEANS

[75] Inventors: Martin Stevens Smith, Chelmsford; Adrian David Smith, Paignton; James Edward Joseph Dalley, Harlow; Stephen John McKenna, Torquay, all of United Kingdom

[73] Assignee: Northern Telecom Limited, Montreal, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/850,428

[22] Filed: May 2, 1997

[30] Foreign Application Priority Data

May 2, 1996 [GB] United Kingdom ..... 9609265

[51] Int. Cl.[7] ..... H01Q 13/10

[52] U.S. Cl. ..... 343/700 MS; 343/770; 343/778; 343/815

[58] Field of Search ..... 343/700 MS, 815, 343/770, 778

[56] References Cited

U.S. PATENT DOCUMENTS

| | | | |
|---|---|---|---|
| 5,469,181 | 11/1995 | Yarsunas | 343/815 |
| 5,477,231 | 12/1995 | Medard | 343/700 MS |
| 5,614,915 | 3/1997 | Webb | 343/770 |

*Primary Examiner*—Don Wong
*Assistant Examiner*—James Clinger
*Attorney, Agent, or Firm*—Lee, Mann, Smith, McWilliams, Sweeney & Ohlson

[57] ABSTRACT

The present invention relates to antennas. One of the problems which arises during the operation of a linear array antenna with electrical downtilt is that cross-polar radiation currents are generated. These cross-polar radiation currents, if at the same frequency as the operating band of the antenna, interfere with the required gain of the antenna. The present invention provides a solution to cross-polar radiation currents with an antenna assembly comprising first and second apertured ground planes with an antenna probe feed network printed upon a dielectric substrate supported therebetween, the array of radiating elements having different phase input feeds, wherein an outwardly extending ground plane flange extends from one of the apertured ground planes. There is also provided a method of receiving and transmitting signals by means of a layered antenna of this construction.

9 Claims, 9 Drawing Sheets

Cross Sectional view of a single column
View of reflector tray only (from the rear)
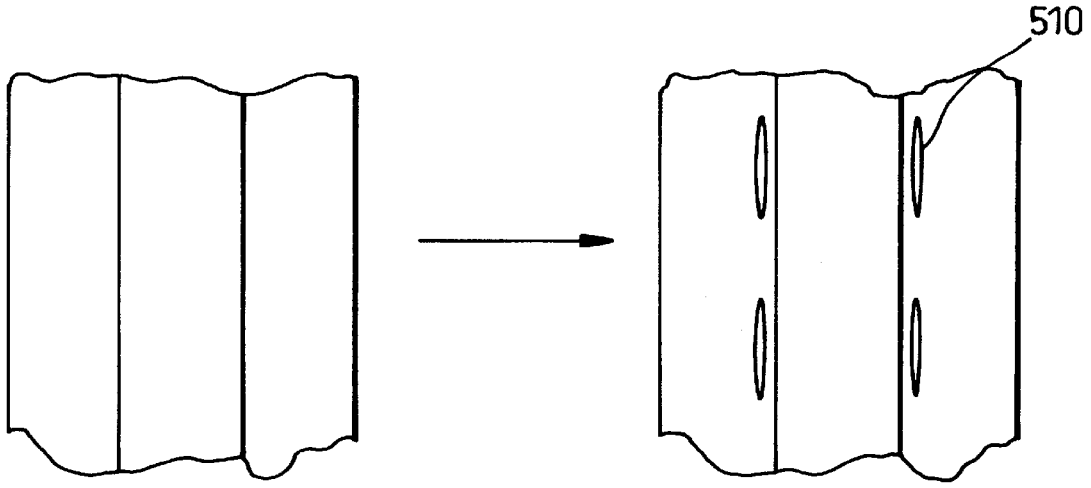
Fig. 5(iii) Fig. 5(iv)

ANTENNA CROSS-POLAR SUPPRESSION MEANS

FIELD OF THE INVENTION

This invention relates to layered antennas and in particular relates to antenna cross-polar suppression means.

BACKGROUND TO THE INVENTION

Cellular radio systems are used to provide telecommunications to mobile users. In order to meet the capacity demand, within the available frequency band allocation, cellular radio systems divide a geographic area to be covered into cells. At the centre of each cell is a base station through which the mobile or fixed outstations communicate with each other and with a fixed (wired) network. The available communication channels are divided between the cells such that the same group of channels are reused by certain cells. The distance between the reused cells is planned such that co-channel interference is maintained at a tolerable level.

When a new cellular radio system is initially deployed operators are often interested in maximising the uplink (mobile station to base station) and downlink (base station to mobile station) range. Any increase in range means that less cells are required to cover a given geographic area, hence reducing the number of base stations and associated infrastructure costs. The downlink range is primarily increased by increasing the radiated power from the base station. National regulations, which vary from country to country, set a maximum limit on the amount of effective isotropic radiated power (EIRP) which may be emitted from a particular type of antenna being used for a particular application. In Great Britain. for example. the EIRP limit for digital cellular systems is currently set at +56 dBm. Hence the operator is constrained and, in order to gain the maximum range allowable, must operate as close as possible to the EIRP limit. without exceeding it.

One form of layered antenna (an antenna having ground planes, feed networks and dielectric spacers arranged in layers) is known from British Patent GB-B-2261554 (Northern Telecom) and comprises a radiating element including a pair of closely spaced correspondingly apertured ground planes with an interposed printed film circuit, electrically isolated from the ground planes. the film circuit providing excitation elements or probes within the areas of the apertures, to form dipoles, and a feed network for the dipoles. A sectional view of such an antenna is shown in FIG. 1: a frontal view of the first three radiating elements is shown in FIG. 2.

The array antenna is constructed of a first apertured metal or ground plane 10, a second like metal or ground plane 12 and an interposed film circuit 14. Conveniently the planes 10 and 12 are fiat, thin metal sheets, e.g. of aluminium, and have substantially identical arrays of apertures 11 formed therein by, e.g. press punching. In the embodiment shown the apertures are rectangular and formed as a single linear array. The film circuit 14 comprises a printed copper circuit pattern 14*a* on a thin dielectric film 14*b*. When sandwiched between the apertured ground planes part of the copper pattern 14*a* provides probes 16, 18 which extend into the areas of the apertures. The probes are electrically connected to a common feed point by the remainder of the printed circuit pattern which forms a feed conductor network in a conventional manner. In the embodiment shown the totality of probes in the array form a vertically polarised antenna when the linear array is positioned vertically. In a conventional triplate structure the film circuit is located between and spaced from the ground planes by sheets of foamed dielectric material 22. Alternative mechanical means for maintaining the separation of the feed conductor network may be employed, especially if the feed network is supported on a rigid dielectric. Referring now to FIG. 2, the linear array comprises of a number of radiating elements 201 which have radiating probes 216 and 218 oppositely directed within aperature 210.

In order to increase output from the antenna in a primary radiating direction, the antenna may further comprise a further ground plane placed parallel with and spaced from one of the apertured ground planes to form a rear reflector for the antenna. Signals transmitted by the antenna towards the back plane are re-radiated in a forward direction.

Typically, for a cellular wireless communications base station, there is a linear arrangement of a plurality of spaced apart antenna radiating apertures/elements to form a linear array. It is often the case that an m x n planar antenna array is constructed from m linear arrays having n radiating apertures spaced at regular intervals. In cellular radio base stations, the antennas are generally arranged to cover sectors, of typically 120° in azimuth—for a tri-sectored base station. Each vertically oriented antenna array is positioned parallel with the other linear antenna arrays. The radiating antenna elements of a vertical array co-operate to provide a central narrow beam coverage in the elevation plane and broad coverage in azimuth, radiating normally in relation to the vertical plane of the antenna array. In the elevation plane the radiation pattern consists of a narrow "main" beam with the full gain of the antenna array, plus "side lobes" with lower gains. This type of antenna lends itself to a cheap yet effective construction for a planar array antenna.

Downtilt in the cellular radio environment is used to decrease cell size from a beam shape directed to the horizon to the periphery of the cell. This provides a reduction in beam coverage, yet allows a greater number of users to operate within a cell since there is a reduction in the number of interfering signals.

This tilt can be obtained by mechanically tilting the antenna array or by differences in the electrical feed network for all the antenna elements in the antenna array. Mechanical downtilting is simple but requires optimisation on site and can only provide a physical tilt, i.e. the beam shape with respect to the antenna is not changed; electrical downtilting allows simple installation and is a slightly more complex design. Electrical downtilt can be used to direct a radiation beam downwardly from an axis corresponding to a normal subtended by an array plane to form a conical beam pattern which provides an ideal coverage, especially in the case of tri-cellular antennas. The downtilt results from a consecutive phase change in the signal fed to each antenna element in an antenna array, i.e. the antenna can be said to have a progressive phase feed network. Typically, a downtilt of 2.5° or 5° is employed. but this can vary depending on the terrain local to a base station.

This progressive phase change (n°), however, introduces cross polar radiation currents (CPRC), as can be seen in FIG. 3, which can be compared with a non-steered flat plate antenna (i.e. having no progressive phase difference between the radiating elements). Cross polar radiation currents in turn provide gain associated with such cross polar radiation currents, and this reduces the required gain of the antenna in the azimuth direction. FIG. 4 provides a graphical representation of a loss in gain across a portion of the band attributable to cross-polar radiation.

Careful design of the dimensions of the apertures and the elements coupled with the design of the electrical characteristics of the feed network for the elements can control the cross-polar radiation to some extent, but this is not wholly effective. The Applicants have determined an antenna array providing electrical downtilt (whereby the feed network provides a progressive phase distribution for the radiating apertures), cross-polar radiation levels at resonant frequencies arise in the apertured ground planes which reduce the gain in the operating frequency band.

OBJECT OF THE INVENTION

The present invention seeks to provide an improved layered antenna with a progressive phase feed network and a method of operating the same.

SUMMARY OF THE INVENTION

According to the present invention there is provided a linear array layered antenna assembly the antenna comprising first and second apertured ground planes with an antenna probe feed network printed upon a dielectric substrate supported therebetween, the array of radiating elements having different phase input feeds, wherein an outwardly extending ground plane flange extends from one of the apertured ground planes, whereby resonant cross-polar fields are suppressed.

Preferably, the antenna further comprises a reflecting ground plane with a central planar portion spaced from the apertures a distance of $\lambda/4$ from and parallel with the apertures. Preferably, the reflecting ground plane portion has shoulder portions spaced in close proximity (of the order of millimeters) either side of the central portion, wherein longitudinal slots are formed in the shoulders parallel with respect to the axis of the longitudinal array, such slots being generally rectilinear or ellipsoidal. These slots extend in the region corresponding to the spaces between the apertures in the apertured ground planes.

In accordance with a further aspect of the invention. there is also provided a method ot receiving and transmitting radio signals in a cellular arrangement including a linear array layered antenna assembly the antenna comprising first and second apertured ground planes with an antenna probe feed network printed upon a dielectric substrate supported therebetween, the array of radiating elements having different phase input feeds, wherein an outwardly extending ground plane flange extends from one of the apertured ground planes;

wherein the method comprises, in a transmission mode. the steps of feeding signals from transmit electronics into the antenna radiating elements via feeder cables and, in a receive mode, the steps of receive electronics, the characteristic frequency of cross-polar radiation induced across the antenna being such that resonant cross-polar fields are suppressed in the desired frequency band of operation of the antenna, whereby gain in the desired frequency band of operation of the correct polarisation is maintained.

BRIEF DESCRIPTION OF THE DRAWINGS

In order that the invention can be more fully understood, reference shall now be made to the Figures as shown in the accompanying drawing sheets, wherein.

DETAILED DESCRIPTION OF PREFERRED EMBODIMENTS

Figure 3:
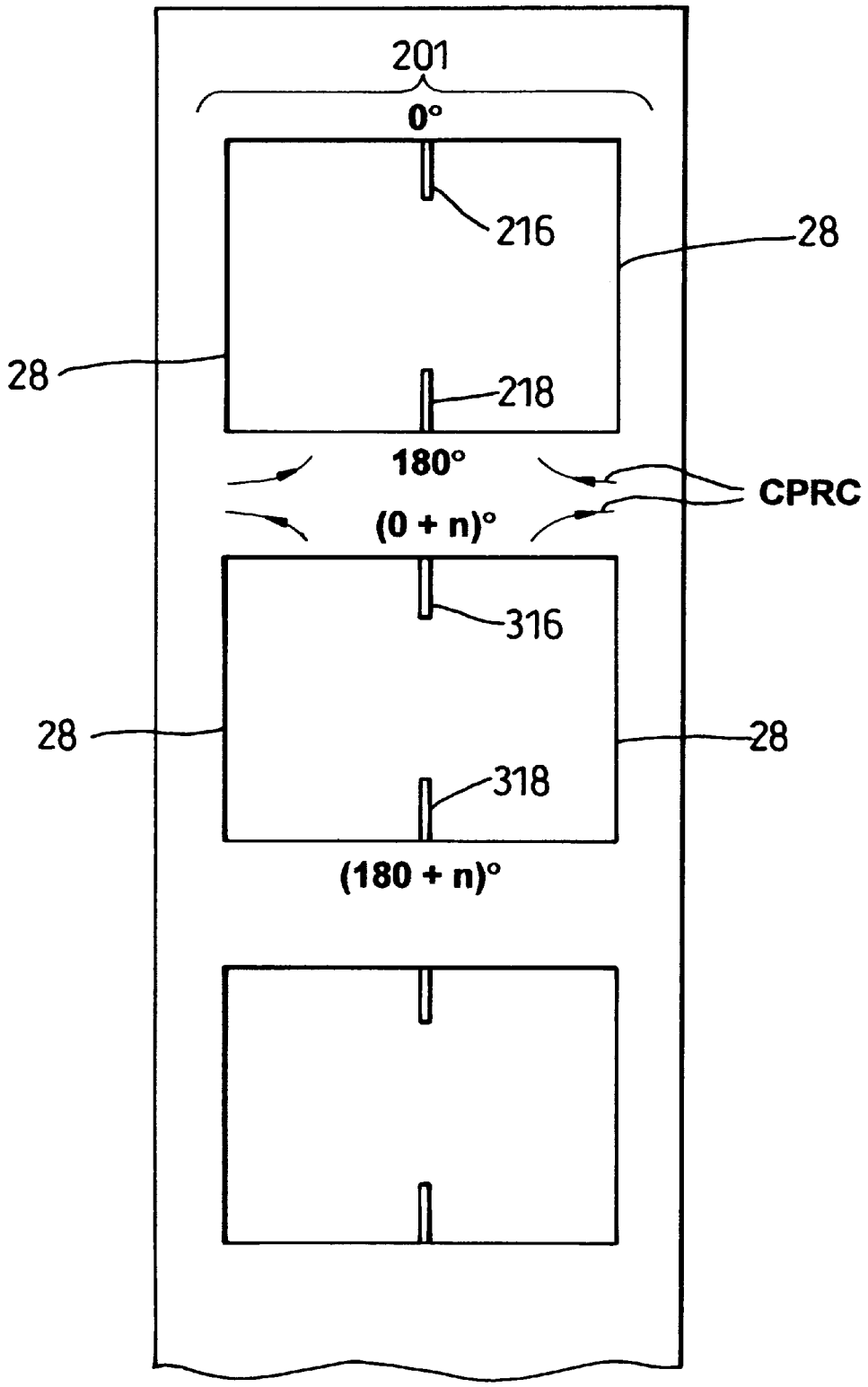
FIG. 3 is a frontal view of layered antenna with a non-uniform phase distribution in its feed network.
Figure 4:
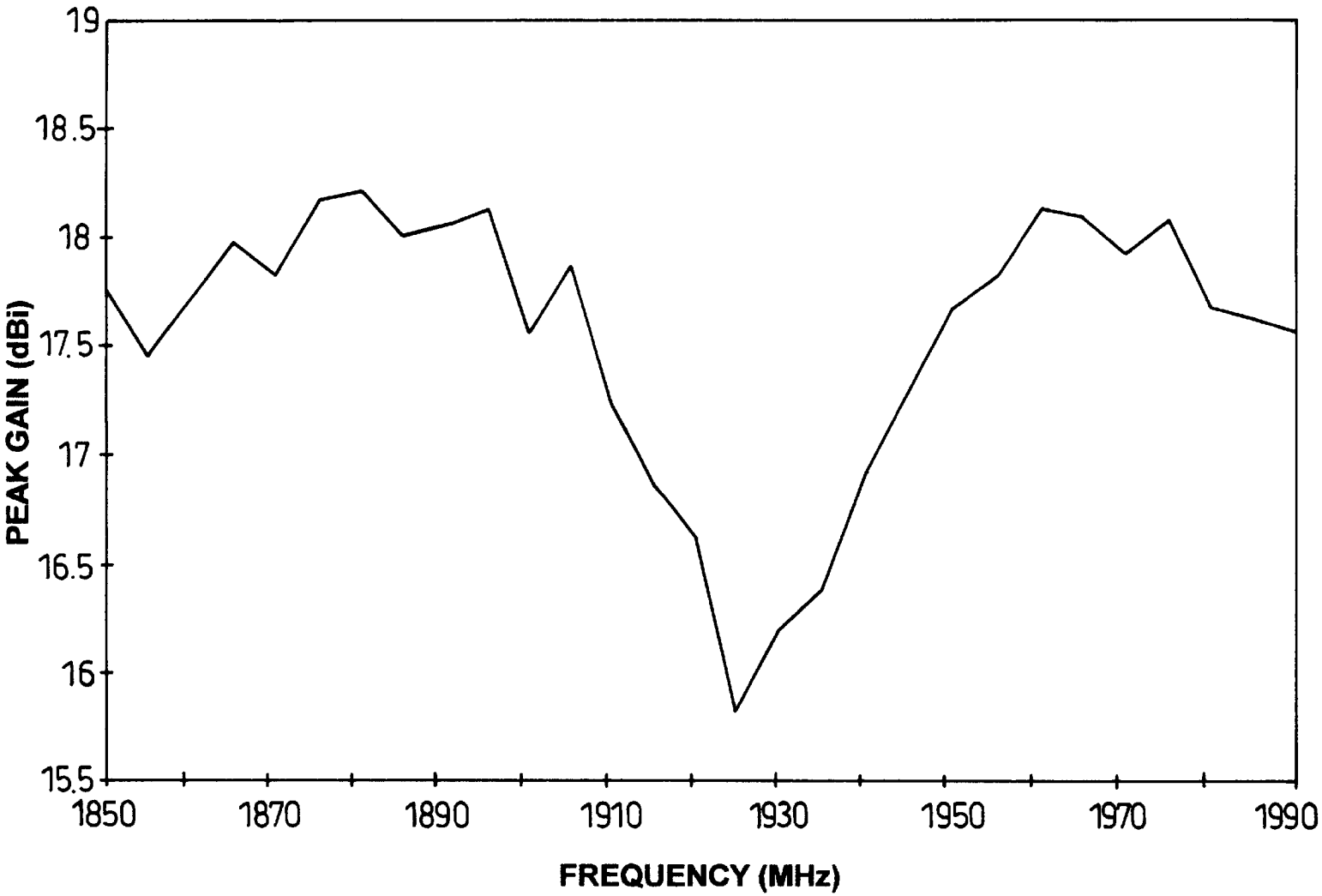
FIG. 4 is a graphical representation of the effects of cross-polar radiation in an antenna frequency band in a prior art antenna.

The layered antenna element shown in FIG. 3 comprises an array of rectangular apertures 210 in first 20 and second (not shown) metallic ground plane. A dielectric sheet substrate supports a metallic conductor pattern consisting of a pair of radiating probes 216, 218 for each aperture and a common feed network (not shown) is positioned between the two spacers between the apertured ground planes. A feed point (not shown) is provided for connection to an external feed (also not shown). The feed network is positioned so as to form a microstrip transmission line with portions of the ground planes defining the rectangular apertures. The position of the feed point is chosen so that when an r.f. signal of a given frequency is fed to the network the relative lengths of the two portions of the network are such as to cause the pair of probes 216 and 218 to be fed in anti-phase, thereby creating a dipole antenna radiating element structure. Furthermore, the dimensions of the rectangular apertures and the bounding portions of the ground plane are chosen so that the bounding portions 28 parallel with the probes 216, 218 act as parasitic antenna radiating elements, which together with the pair of radiating probes determine the radiation pattern of the antenna.

Figure 1:
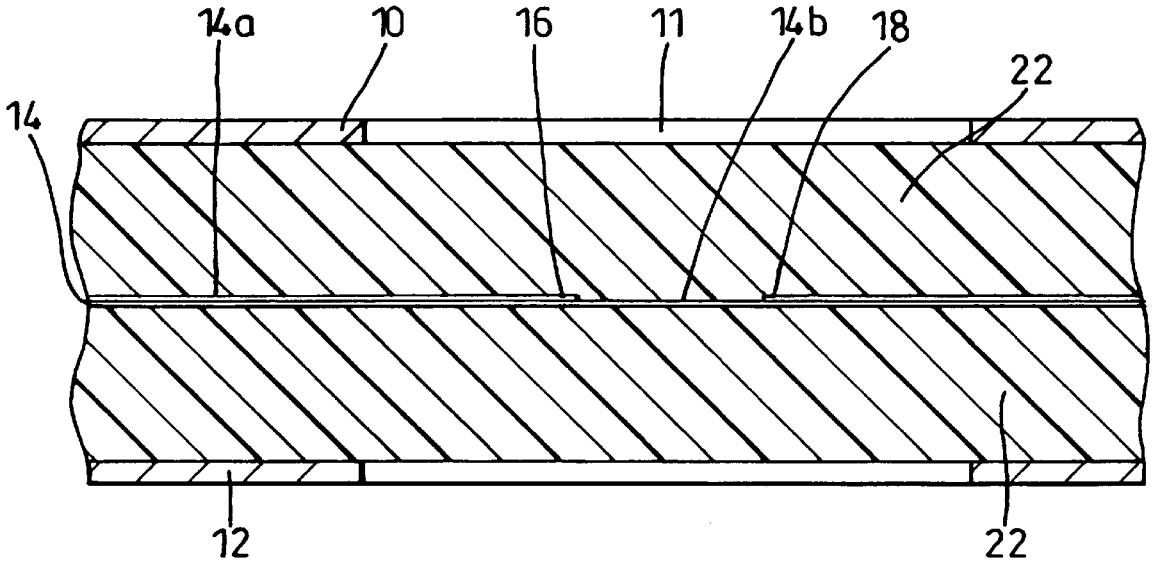
FIG. 1 is a sectional view of a first type of layered antenna.
Figure 2:
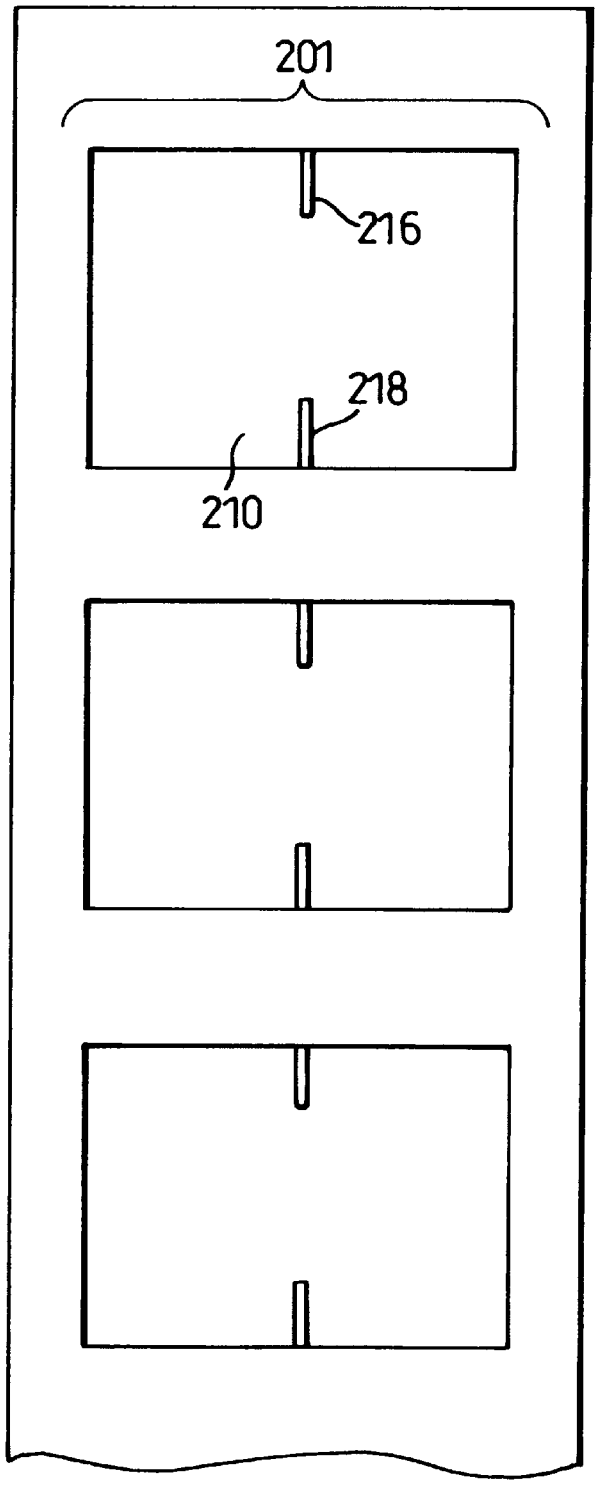
FIG. 2 is a frontal view of part of the antenna shown in FIG. 1.

The ground planes are spaced from the plane of the feed network by dielectric spacing means (as shown in FIG. 1) so that the feed network is spaced from both ground planes. Spacing between the network and the ground planes can be determined by foamed dielectric sheets or dielectric studs interposed between the various layers. Alternative mechanical means for maintaining the separation of the feed conductor network may be employed, especially if the feed network is supported on a rigid dielectric. The ground planes are conveniently formed from aluminum alloy sheet, by reason of its light weight, strength and high corrosion resistance, although metallised plastics may also be employed.

In a layered or flat plate arrangement the antenna arrays are arranged vertically to provide a beam which is narrow in elevation. The microwave signals from the base station transmitter are introduced or coupled to an antenna array feed network printed upon a dielectric substrate of an antenna by, typically, a coaxial line arrangement. The feed network provides a signal for each antenna element. The radiation pattern provided by each antenna element co-operates with the radiation pattern provided by the other antenna elements within an antenna array whereby the resulting radiation intensity distribution is the sum of all the radiation distributions of all the antenna elements within the antenna array. The antenna array can be deployed mounted on a mast or other type of suitable structure.

Figures 5, 5I:
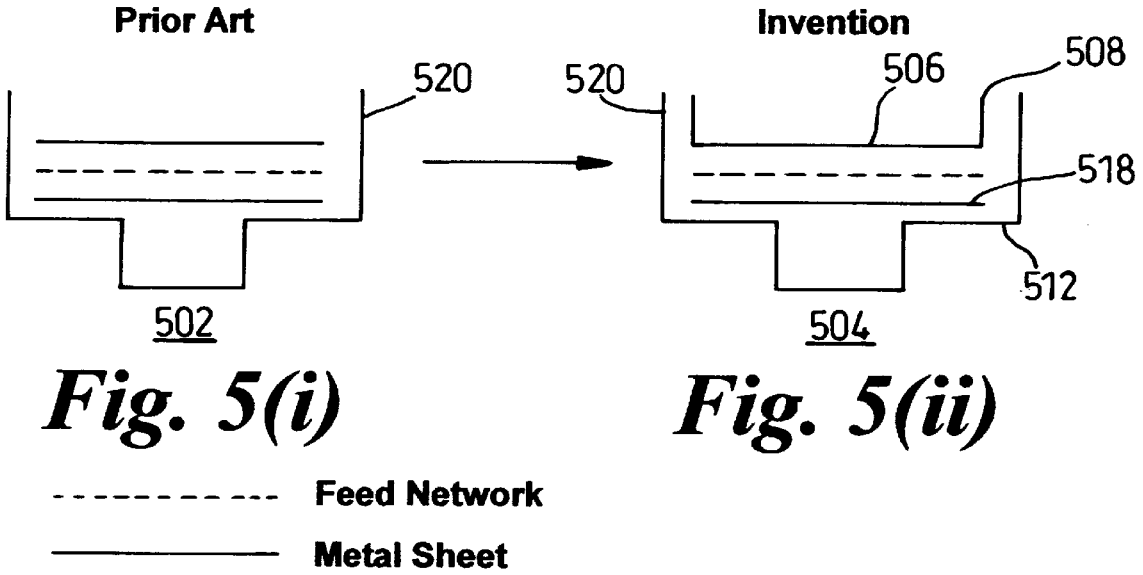
FIGS. 5i–iv are sectional and overhead views of two antenna reflector ground planes.

FIGS. 5i and 5ii show the differences in cross-section between an antenna 502 known from GB 9609265.5 (FIG. 5i) and an antenna 504 made in accordance with the invention (FIG. 5ii); FIGS. 5iii and iv show the respective differences in the reflecting ground planes. In FIG. 5ii, the uppermost apertured ground plane 506 possesses upstanding flange members 508. It is believed that the resonant frequency of the apertured ground plane is thereby decreased which reduces the frequency of the resonant cross polar radiation fields; FIG. 5*iv* shows slots 510 in the reflecting ground plane 512 in accordance with a preferred embodiment.

Figure 6I:
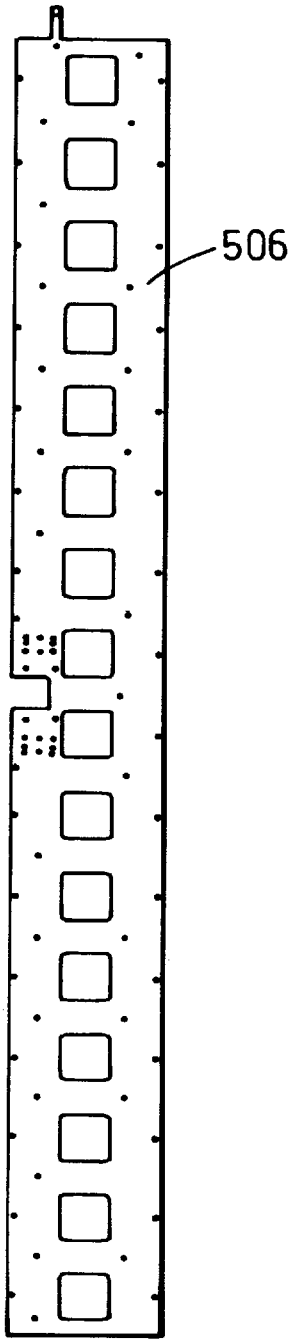
FIGS. 6i–ii are views of the apertured and reflecting ground planes in accordance with a first embodiment of the invention.
Figure 6:
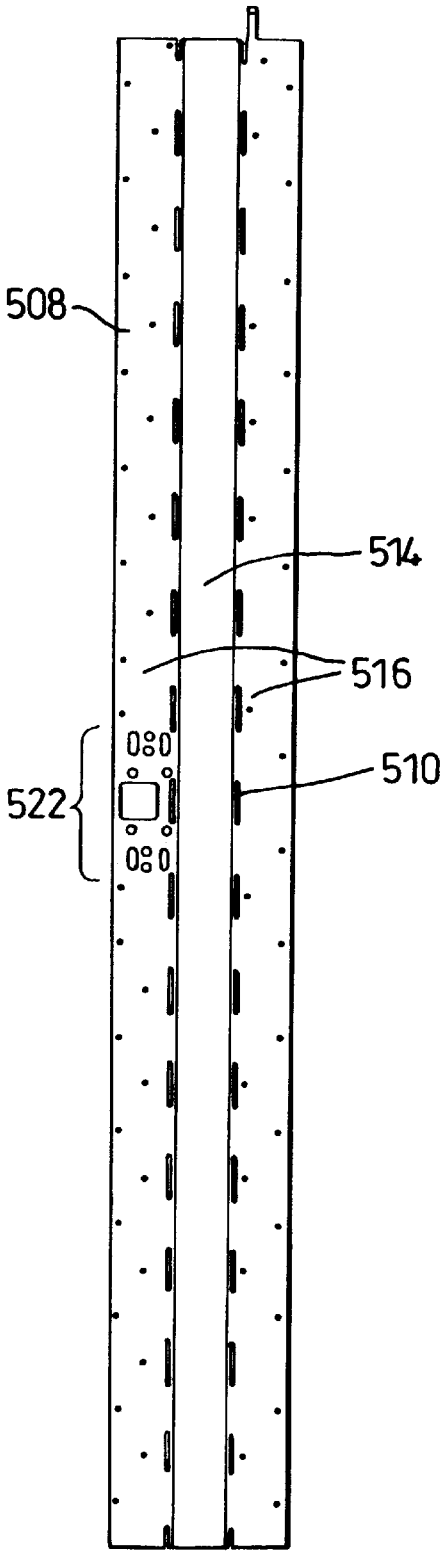

With reference to FIGS. 6*i*, 6*ia* and 6*ii*, there is shown in detail, respectively, the upper apertured ground plane 506, a sectional view thereof and reflector ground plane sheet 508 of a preferred embodiment of the invention. The reflector ground plane comprises a central portion 514 spaced a distance of $\lambda/4$ from and parallel with the apertures and shoulder portions 516 spaced in close proximity (of the order of millimeters) to the lower apertured ground plane either side of the central portion and from which the near field interference reduction flanges extend. The longitudinal slots 510 are formed in the shoulders 516 parallel with respect to the axis of the longitudinal array, such slots being generally rectilinear or ellipsoidal. It has been determined that for an antenna operating at 1900 MHz, square apertures of length 63 mm with a 105 mm spacing perform well with 53 mm long slots. These slots extend in the region corresponding to the spaces between the apertures in the apertured ground planes and have a width of 3 mm, and are spaced from the central portion by 3 mm. It is believed that these slots interrupt the cross polar surface fields induced on the reflecting ground plane and thereby reduce the effect of such. With respect to the apertures 522 on one shoulder of the reflector ground plane, these are associated with the termination of the coaxial feed cable which connects with the feed network on the dielectric sheet spaced between the apertured ground planes.

Figure 7:
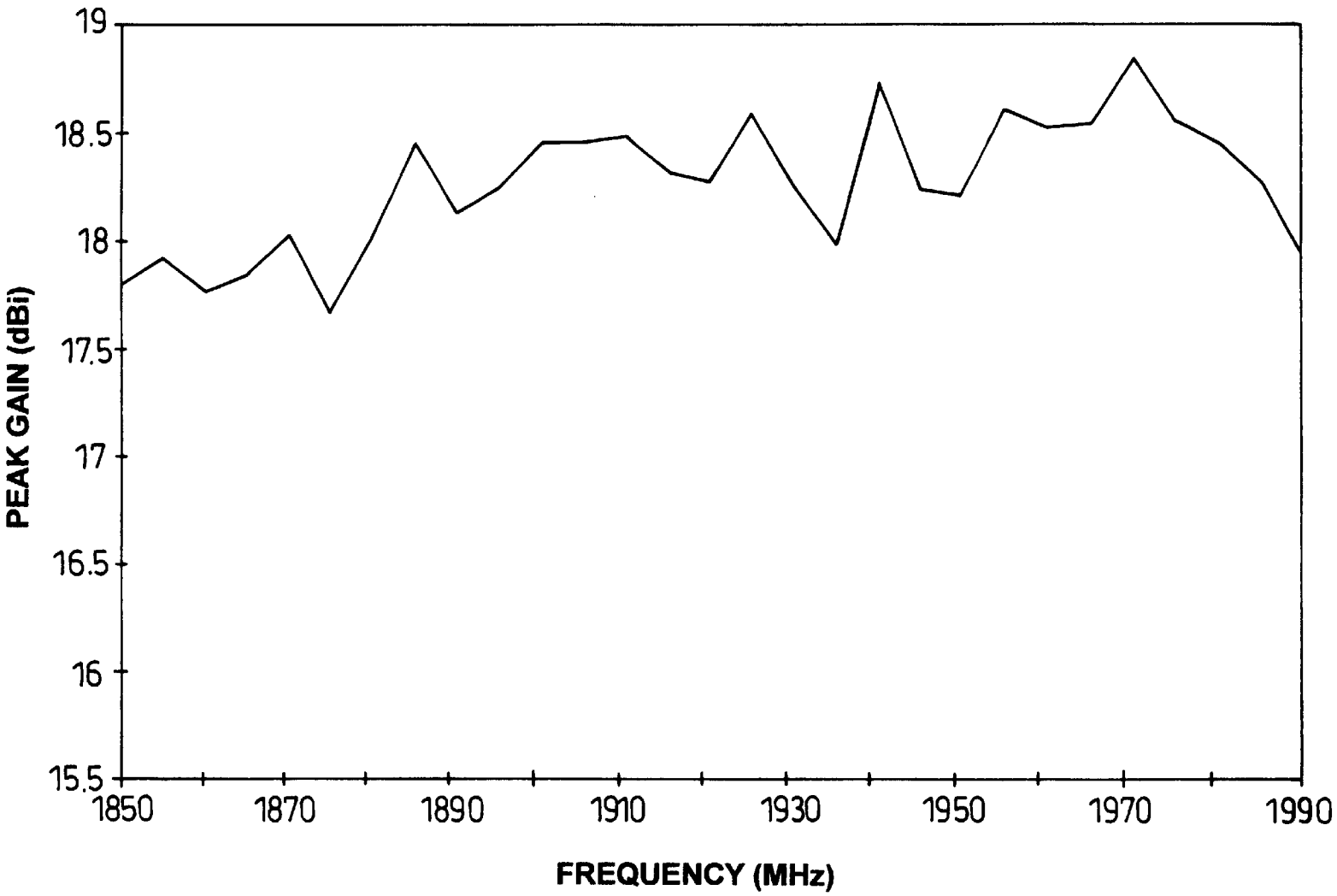
FIG. 7 is a graphical representation of the effects of the reduction of cross-polar radiation in an antenna frequency band in an antenna made in accordance with the invention.

When the antenna operates in transmission mode, radio signals are fed to the antenna feed network by, for example. input/output feeds from a base station controller, via amplifiers. The feed network divides so that feed probes may radiate within areas defined by apertures in a ground plane of each antenna array. The feed network also induces phase changes for each successive aperture thereby providing electrical downtilt, which progressive phase change induces cross-polar radiation fields, the characteristic frequency of operation of which is changed by the flanges 508 and thereby such cross-polar radiation is removed out of the frequency of operation of the antenna, thereby not affecting the desired gain of the antenna. Flange 520 assists in reducing coupling effects between antenna arrays. FIG. 7 shows a graphical representation of the improved performance of the antenna: the dip in gain due to the cross-polar resonance has been shifted in frequency. out of the operating frequency band of the antenna.

Figure 8:
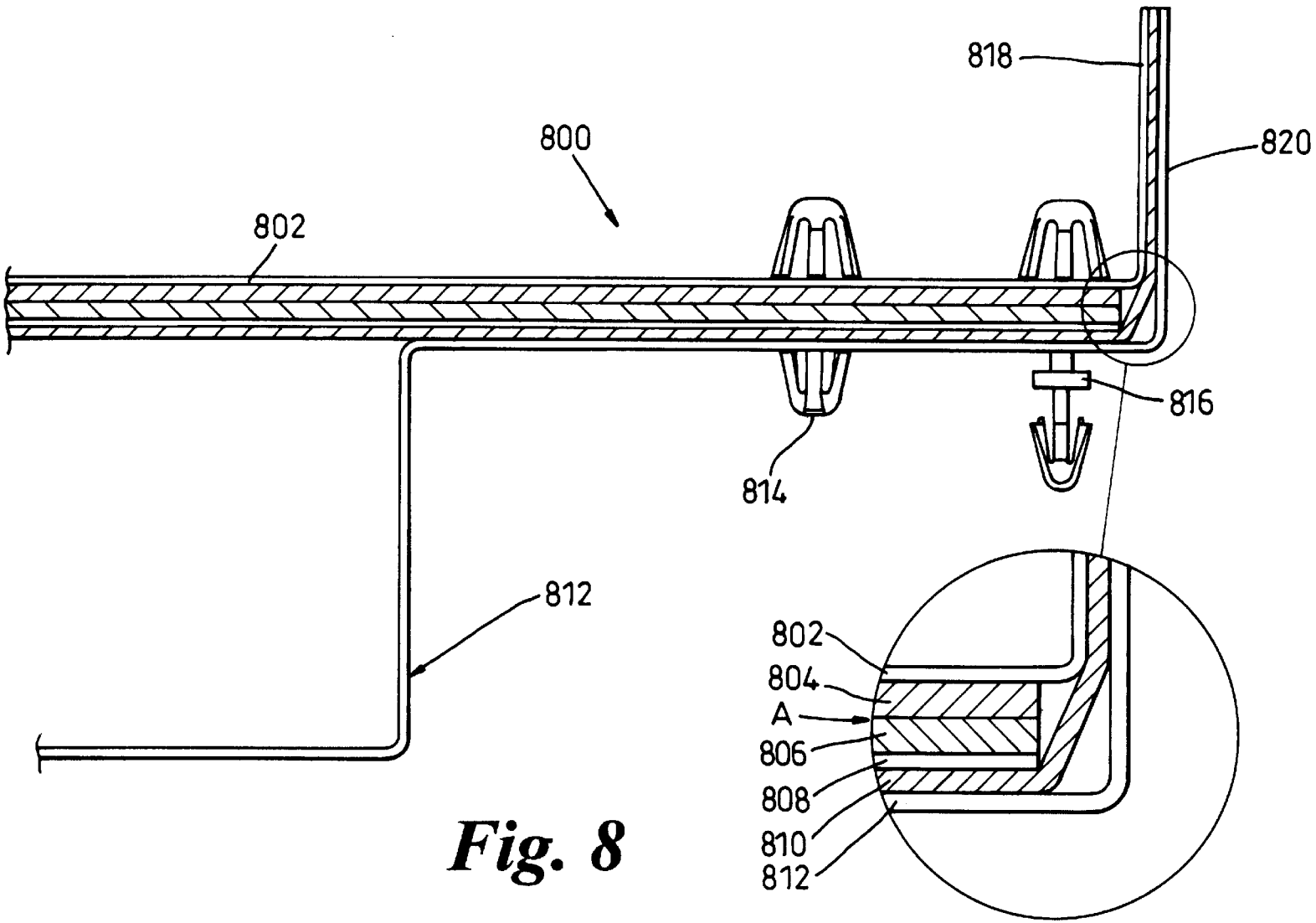
FIG. 8 illustrates a detailed sectional view of an antenna array made in accordance with the invention.

FIG. 8 shows a cross sectional view of a preferred embodiment: the antenna 800 comprises a first apertured ground plane 802, first and second foamed dielectric spacers 804. 806 which support a thin dielectric sheet, not shown but indicated by arrow A. which dielectric sheet supports the radiating probes and electrical feed network, a second, lower apertured ground plane 808, third foam dielectric spacer 810 and a reflecting ground plane 812 Plastic clip fastener retaining means 814, 816 maintain the ground planes together and provide attachment to a support frame (not shown) respectively.

It is preferred that flange 818 extends from the outer apertured ground plane whereby construction is relatively simple; It is possible to fabricate this flange member from the inner apertured ground plane, but there would then be a risk that point contacts between the two apertured ground planes would arise, which would result in the output radiation being less well controlled due to discontinuities arising in joins between the two ground planes. In this embodiment, both the first apertured ground plane and the reflecting ground plane have flanges 818, 820 which extend outwardly beyond the radiating plane of the antenna extending from the arrays are formed as extensions from the reflector ground plane, the flanges associated with the reflector ground plane assist in reducing interference effects.

In a preferred embodiment, the arrays measure 1.7 m long and are 0.2 m wide. The apertures are of the order 40–70 mm square and the reflector plane is spaced 15–50 mm behind the dielectric feed network. The flanges 818 can vary in height from 10–40 mm, depending upon the desired properties of the antenna—if the flanges are too high, then the beam shape can be narrowed in azimuth to too great an extent The beam shape is. in any case optimised for a particular requirement by. inter alia, tuning the height and position of the flanges. In the case of tri-cellular or corner excited base stations, it is particularly advantageous that the beams are narrow in azimuth. It is possible, in a further embodiment to manufacture the outer apertured ground plane and the reflector ground plane from the same extruded tube: no point contact problems would be caused by discontinuities arising in joins between the two ground planes. Alternatively, wave soldering techniques could be employed whereby a continuous seal between the two component ground planes takes place.

Figure 9:
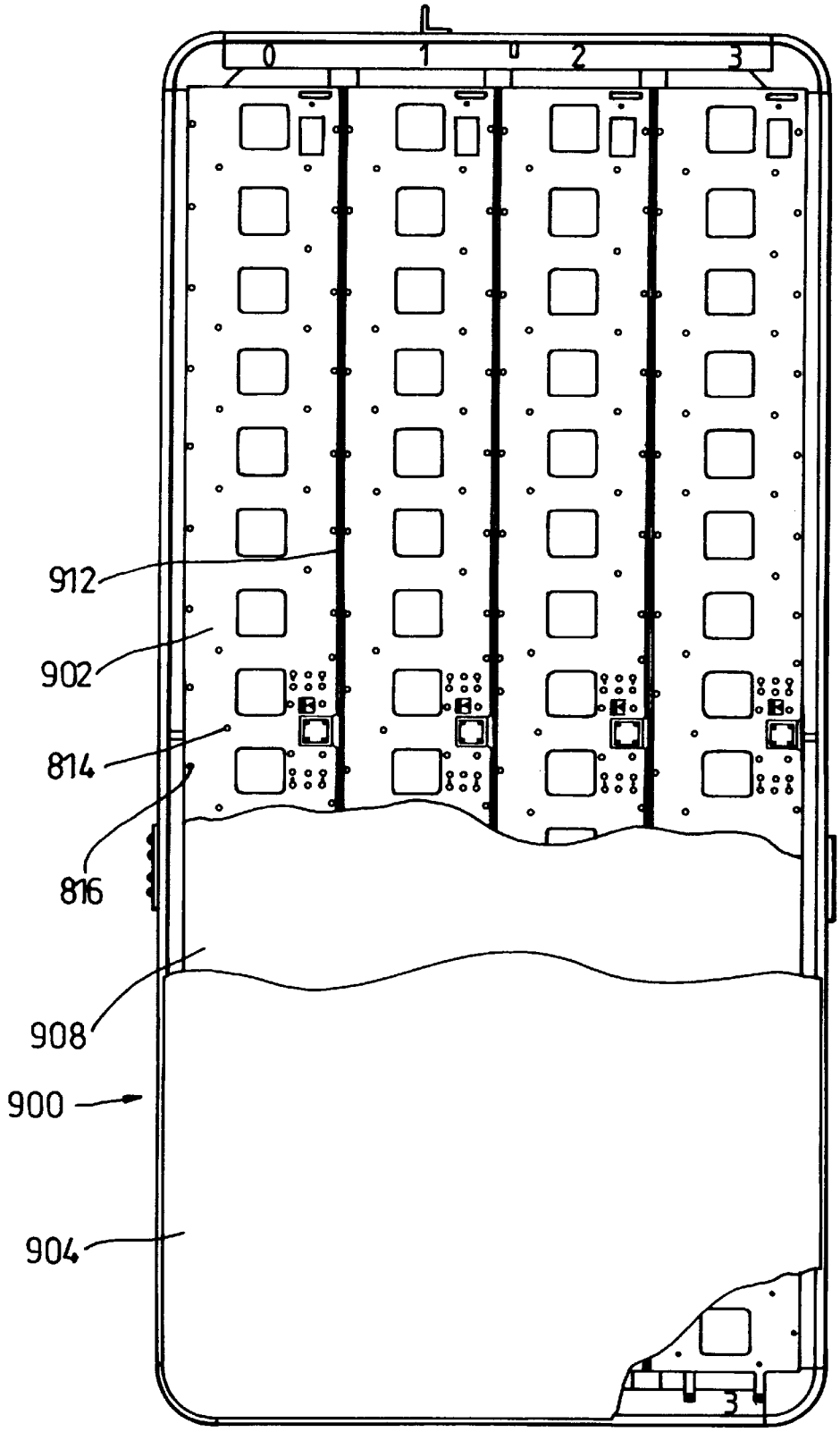
FIG. 9 shows a view of an antenna facet, part cut-away.

FIG. 9 shows a facet 900 of a base station antenna made in accordance with the invention. The facet comprises four linear arrays 902 arranged in a parallel spaced apart relationship, with a radome 904 (shown part cut-away). The antenna arrays are mounted upon a frame 912. The support frame is conveniently a metal structure and of sufficient strength to support antenna arrays which may be subject to inclement weather conditions. Electrically insulating fasteners 814 connect the array components together; the arrays being attached to the supporting frame 912 by further electrically insulating fasteners 816. Dielectric foam 908 is placed in front of the arrays and functions as a load spreader for the radome 904, to assist in maintaining the radome in position. Radomes are conveniently made from polycarbonate which is susceptible to flexing in use if not supported, which flexing may affect the performance of the antenna. Signals from the control electronics are passed through a connector (not shown) to the antenna feed network. A metallised sheet (not shown) may be placed around the rear of the antenna to contain emissions radiating rearwardly of the antenna, which emissions can cause the formation of unwanted intermodulation products.

In the case of electrical downtilt, the feed network provides varying paths from a feed input to each of the antenna feed probes of the antenna array. The varying paths introduce differences in path length. The phase shifts in the feed paths for the antenna elements have been effected progressively across the antenna array (also known as a phase taper) which have the primary result of effecting downtilt. Typically, a phase taper for an array will produce 10–90° phase difference between antenna elements of an array, which elements are spaced ½–¾ wavelengths apart. The many benefits in the design and installation of such antenna arrays in comparison with mechanical downtilting can easily be envisaged; moreover, the coverage defined is near uniform by reason of the nulls between lobes not being significant.

Alternatively, the feed paths need not be grouped for antenna elements having similar phase shifts, but the power split between tracks of the feedback path can be such that. in addition to the progressive phase change, a progressive amplitude difference for the antenna elements be effected. The effect of changing the amplitude of a feed input for the antenna elements is in many ways similar to the effect of changing the phase of a feed input for a group of elements. since both the amplitude and phase are components of the complex excitations of the radiated signals.

We claim:

1. A linear array layered antenna assembly the antenna assembly comprising first and second apertured ground planes with an antenna assembly probe feed network printed upon a dielectric substrate supported therebetween, the probe feed network providing an array of antenna probes having different phase input feeds, wherein an outwardly extending ground plane flange extends from one of the apertured ground planes, whereby resonant cross-polar fields are suppressed in a desired frequency of operation of the antenna.

2. An antenna according to claim 1 further comprising a reflecting ground plane with a central planar portion spaced from the apertures a distance of $\lambda/4$ from and parallel with the apertures.

3. An antenna according to claim 1 further comprising a reflecting ground plane with a central planar portion spaced from the apertures a distance of $\lambda/4$ from and parallel with the apertures and shoulder portions spaced in close proximity with the lower apertured ground plane either side of the central portion.

4. An antenna according to claim 1 further comprising a reflecting ground plane with a central planar portion spaced from the apertures a distance of $\lambda/4$ from and parallel with the apertures and shoulder portions spaced in close proximity either side of the central portion, wherein longitudinal slots are formed in the shoulders parallel with respect to the axis of the longitudinal array, such slots being generally rectilinear and extend in the region corresponding to the spaces between the apertures in the apertured ground planes.

5. An antenna according to claim 1 further comprising a reflecting ground plane with a central planar portion spaced from the apertures a distance of $\lambda/4$ from and parallel with the apertures and shoulder portions spaced in close proximity either side of the central portion, wherein longitudinal slots are formed in the shoulders parallel with respect to the axis of the longitudinal array, such slots being generally ellipsoidal and extend in the region corresponding to the spaces between the apertures in the apertured ground planes.

6. An antenna according to claim 1 wherein a separate outwardly extending ground plane member is provided, between two adjacent arrays.

7. An assembly according to claim 1 wherein the ground planes are formed from an aluminium alloy.

8. An assembly accrording to claim 1 wherein the ground planes are formed from a plastics member having a conductive. grounded metallised coating.

9. A method of receiving and transmitting radio signals in a cellular arrangement including a linear array layered antenna assembly the antenna assembly comprising first and second apertured ground planes with an antenna probe feed network printed upon a dielectric substrate supported therebetween, the probe feed network providing an array of antenna probes having different phase input feeds, wherein an outwardly extending ground plane flange extends from one of the apertured ground planes;

wherein the method comprises, in a transmission mode, the steps of feeding signals from transmit electronics into the antenna radiating elements via feeder cables and, in a receive mode, the steps of receiving signals via the radiating elements and feeder cables to receive electronics, the characteristic frequency of cross-polar radiation induced across the antenna being such that resonant cross-polar fields are suppressed in the desired frequency band of operation of the antenna, whereby gain in the desired frequency band of operation of the correct polarisation is maintained.

* * * * *